US005434378A

United States Patent [19]

McLean

[11] Patent Number: 5,434,378

[45] Date of Patent: Jul. 18, 1995

[54] MULTI-POSITION SWITCH WITH SWITCH ACTUATOR MOVEMENT INHIBITOR ASSEMBLY

[75] Inventor: Thomas M. McLean, Milford, Conn.

[73] Assignee: Hubbell Incorporated, Orange, Conn.

[21] Appl. No.: 214,433

[22] Filed: Mar. 18, 1994

[51] Int. Cl.[6] ..... H01H 15/00

[52] U.S. Cl. ..... 200/537; 200/547; 200/43.11; 200/43.16; 200/43.19; 200/43.21; 200/43.22; 337/298; 362/802

[58] Field of Search ..... 200/43.11, 43.13, 43.14, 200/43.16, 43.17, 43.18, 43.19, 43.21, 43.22, 61.58 R, 537, 547, 321; 337/298; 362/802

[56] References Cited

U.S. PATENT DOCUMENTS

| | | | |
|---|---|---|---|
| 3,839,614 | 10/1974 | Saganowski et al. | 200/321 |
| 4,006,334 | 2/1977 | Robotham et al. | 200/157 |
| 4,598,182 | 7/1986 | Breslin | 200/43.11 |

*Primary Examiner*—J. Casimer Jacyna
*Assistant Examiner*—Timothy L. Maust
*Attorney, Agent, or Firm*—Jerry M. Presson; Michael R. Swartz

[57] ABSTRACT

A switch inhibitor assembly provided with a multi-position switch is operable for inhibiting movement of an actuator of the switch to a predetermined one of the multiple positions, such as an ON position of a succession of OFF, AUTO and ON positions, of the switch. The actuator is movable between the multiple positions along an elongated channel. The switch inhibitor assembly includes a slide actuator movable along an elongated slot which extends in a generally transverse relationship to the elongated channel. The slide actuator is movable between blocking and unblocking positions relative to and toward and away from the elongated channel. At the blocking position, a portion of the slide actuator extends across a portion of the elongated channel and thereby prevents movement of the switch actuator from the other positions of the switch along the portion of the elongated channel to the predetermined one position thereof. At the unblocking position, the portion of the slide actuator is retracted from across the portion of the elongated channel and thereby permits movement of the switch actuator from the other positions of the switch along the portion of the elongated channel to the predetermined one position of the switch.

11 Claims, 3 Drawing Sheets

MULTI-POSITION SWITCH WITH SWITCH ACTUATOR MOVEMENT INHIBITOR ASSEMBLY

BACKGROUND OF THE INVENTION

1. Field of the Invention

The present invention generally relates to multi-position switches and, more particularly, is concerned with a switch inhibitor assembly for inhibiting movement of an actuator of a multi-position switch to a predetermined one of the multiple positions of the switch.

2. Description of the Prior Art

A passive infrared detection system typically includes a heat sensor, a lens for focusing heat energy on the heat sensor, and an electrical mechanism operatively associated with the heat sensor for providing a detection signal when the heat sensor detects a change of temperature, as for example, caused by the body heat of a passing intruder. One common example of a passive infrared detection system incorporates a pyroelectric detector as the heat sensor.

Thus, the detection system works on the principle of detecting the radiant or heat energy emitted by an object, such as the body of the person, moving across the field or fields of view of the heat sensor and the lens of the detection system. To function properly the detection system must be capable of distinguishing between the moving object and a stationary object also emitting infrared radiation. To accomplish this the system is designed to respond to a change in the level of radiation received so that only the moving object will be detected.

The detection system typically employs a multi-position electrical switch, such as a three-position switch, for controlling the various modes of operation of the system, such as OFF, AUTO and ON. The normally desired operational mode of the detection system is the AUTO mode in which, until an intruder is detected, the electrical mechanism of the system assumes an inactive state during which energy consumption is minimized. By contrast, when the detection system is in the ON mode, the electrical mechanism of the system overrides dependence upon detecting an intruder and instead continuously assumes an active state in which energy consumption is elevated, resulting in a wasteful use of expensive electrical energy. Frequently, the switch actuator is inadvertently moved to the ON position, instead of the AUTO position, resulting in continuing high energy consumption by the system until the condition is discovered.

Consequently, a need exists for a device to inhibit movement of the switch actuator to the ON position and thereby prevent unintended operation of the detection system in the continuous or override ON mode.

SUMMARY OF THE INVENTION

The present invention provides a switch actuator inhibitor assembly designed to satisfy the aforementioned needs. The inhibitor assembly of the present invention is associated with a three-position electrical switch, such as an OFF-AUTO-ON switch, for inhibiting movement of an actuator of the switch to a predetermined one of the multiple positions of the switch, such as the override "ON" position in the sequence of "OFF", "AUTO" and "ON" positions. The inhibitor assembly is made user-friendly by employing a snap-in mechanical slide actuator which can be moved easily between displaced unblocking and blocking positions. The mechanical slide actuator of the inhibitor assembly is readily accessible from a front side of a housing unit of a given system, for instance a detection system, employing the three-position switch and the switch inhibitor assembly after merely removing a housing cover plate and then a slide actuator shield plate from the unit.

Accordingly, the present invention is directed to a switch inhibitor assembly provided in combination with a multi-position switch. The multi-position switch includes a first support structure defining an elongated channel and a switch actuator having a portion projecting into the elongated channel and being movable along the elongated channel between multiple positions of the switch. The switch inhibitor assembly is operable for inhibiting movement of switch actuator along a portion of the elongated channel to a predetermined one of the multiple positions of the switch from the other of the multiple positions of the switch.

The switch inhibitor assembly of the present invention comprises: (a) a second support structure defining an elongated slot spaced from the elongated channel of the first support structure and extending in a generally transverse relationship to the elongated channel; and (b) a slide actuator mounted to the second support structure for undergoing sliding movement along the elongated slot and toward and away from the elongated channel and between a blocking position in which a portion of the slide actuator extends across a portion of the elongated channel and thereby prevents movement of the switch actuator along the portion of the elongated channel to the predetermined one position of the switch, and an unblocking position in which the portion of the slide actuator is retracted from across the portion of the elongated channel and thereby permits movement of the switch actuator along the portion of the elongated channel to the predetermined one position of the switch.

The slide actuator of the switch inhibitor assembly includes a flat body and an attachment lug attached to and projecting from a rear face of the body and through the elongated slot. The attachment lug includes a conical-shaped head portion and a stem portion with a longitudinal slit extending from the head portion partially through the stem portion to permit flexing of the stem portion and inward movement of split parts of the head portion toward one another so as to allow easy installation and removal of the slide actuator respectively to and from the elongated slot. The slide actuator also includes a rib attached to and projecting from a front face of the body to permit gripping of the slide actuator to move the same between the unblocking and blocking positions. The elongated channel has an edge at the portion thereof which is removed for receiving a lower edge of the portion the slide actuator when the slide actuator is disposed in the unblocking position.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 2:
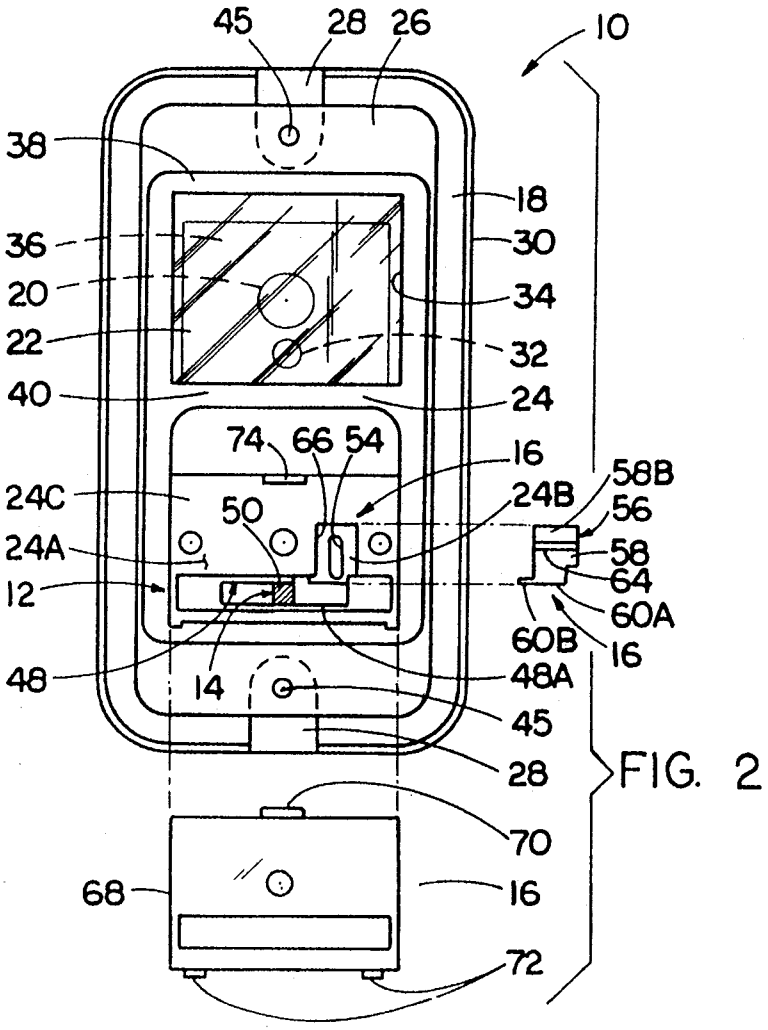
FIG. 2 is a front elevational view of the unit showing the switch inhibitor assembly of the present invention in exploded form after removal of a housing wall plate of the unit.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Figure 1:
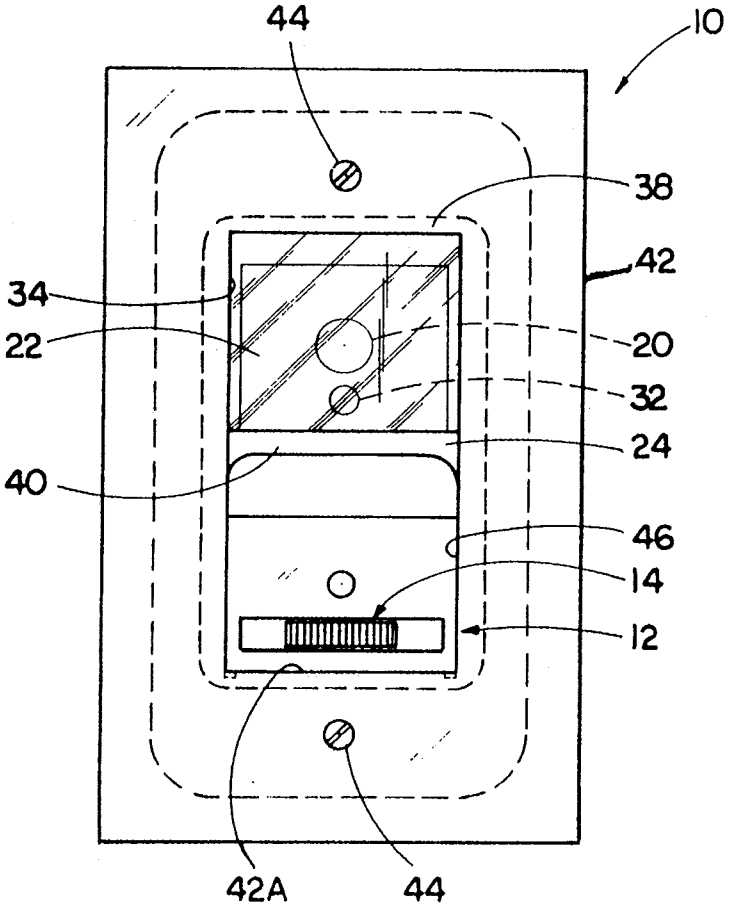
FIG. 1 is a front elevational view of a wall-mounted housing unit of a detection system having a three-position switch and a switch inhibitor assembly of the present invention associated with one of the positions of the switch for inhibiting movement of an actuator to that one position.
Figure 6:
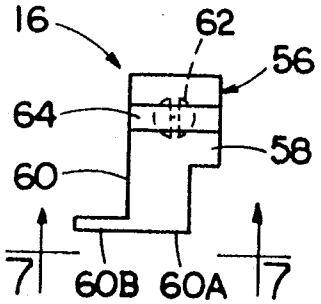
FIG. 6 is a front elevational view of the slide actuator alone as seen along line 6—6 of FIG. 7.
Figure 7:
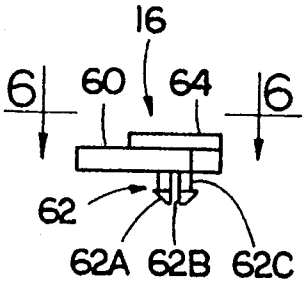
FIG. 7 is a bottom plan view of the slide actuator as seen along line 7—7 of FIG. 6.
Figure 5:
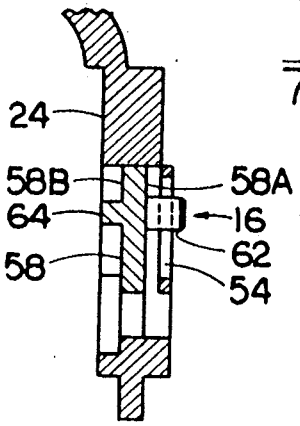
FIG. 5 is a vertical sectional view taken along line 5—5 of FIG. 3.

Referring now to the drawings, and particularly to FIGS. 1 and 2, there is illustrated a passive infrared detection system 10 which incorporates a multi-position switch 12 having a switch actuator 14 slidably movable between a succession of multiple positions, for example, OFF, AUTO and ON positions. As best seen in FIG. 2, the detection system 10 is also provided with a switch inhibitor assembly 16 in accordance with the present invention. The switch inhibitor assembly 16 is operable for inhibiting movement of the switch actuator 14 of the switch 12 to a predetermined one, such as the ON position, of the multiple positions of the switch 12. The multi-position switch 12 and the switch inhibitor assembly 16 are shown and described herein in the environment of the infrared detection system 10 for purposes of illustration only. It is readily apparent that the multi-position switch 12 and the switch inhibitor assembly 16 can be employed together in other applications as well.

Referring to FIGS. 1 and 2, the passive infrared detector system 10 basically includes a housing unit 18, and a heat sensor 20, a transparent lens 22 and an electrical mechanism (not shown) disposed in the housing unit 18. The housing unit 18 includes a support plate 24 and a yoke 26 attaching the support plate 24 to upper and lower tabs 28 of an electrical outlet box 30. The multi-position switch 12, switch inhibitor assembly 16, heat sensor 20, transparent lens 22 and electrical mechanism, as well as other components of the system 10, such as a photocell 32, are mounted on the support plate 24 of the housing unit 18.

The support plate 24 of the housing unit 18 contains an opening 34 in which the heat sensor 20 and photocell 32 are supported by a rear panel 36 which is fitted to the support plate 24 so as to close the opening 34 thereof. The support plate 24 also has a pair of upper and lower arcuate ledges 38, 40 being disposed above and below the opening 34. The transparent lens 22, being preferably having an arcuate shape, is mounted across the opening 34 by and between the upper and lower ledges 38, 40 in front of the rear panel 36 and the heat sensor 20 and photocell 32 supported thereon.

The housing unit 18 also includes a front cover plate 42 removably attached to a front side of the housing unit 18 by a pair of screws 44 inserted through aligned apertures in the cover plate 42 and the yoke 26 and threaded into holes 45 tapped in the upper and lower tabs 28 of the box 30. The front cover plate 42 also contains an opening 46. Through an upper half of the opening 46 in the front cover plate 42, the heat sensor 20 and photocell 32 are exposed and also the lens 22 and the upper and lower ledges 38, 40 are exposed and permitted to project therethrough and beyond the front cover plate 42. Through a lower half of the opening 46 in the front cover plate 42, the switch actuator 14 and the switch inhibitor assembly 16 are exposed.

The heat sensor 20 of the detection system 10 can be a conventional pyroelectric detector operable to detect a change of temperature, for example, such as caused by the body heat of an intruder passing across the field of view of the heat sensor 20 and lens 22. The photocell 32 is operable to sense motion in the field of view. The lens 22 is operable for focusing heat energy on the heat sensor 20 emanating from the intruder passing across the field of view. The electrical mechanism (not shown) is operatively associated with the heat sensor 20 and photocell 32 for providing a detection signal when the photocell 32 detects motion and when a change of temperature above a predetermined level is detected in the heat energy sensed by the heat sensor 20.

The detector system 10 also typically employs the multi-position electrical switch 12, preferably a three-position switch, for controlling the various modes of operation of the system, by movement of the switch actuator 14 to and placement thereof at one of the succession of left OFF, middle AUTO and right ON positions of the switch 12, as seen in FIGS. 1 and 8–10. The normally desired operational mode of the detector system 10 is the AUTO mode in which, until motion of an intruder is detected by the photocell 32, the electrical mechanism of the system 10 (except for the portion thereof associated with operation of the photocell 32, assumes a low or inactive state in which energy consumption is minimized. By contrast, when the detector system 10 is in the ON mode, the system 10 overrides its dependence upon first detecting motion of the passing intruder for turning active and instead is continuously in an active state in which energy consumption is elevated, resulting in the wasteful use of expensive electrical energy. Frequently, the switch actuator 14 is inadvertently moved (or moved by unauthorized users) to the right ON position, instead of the AUTO position. The switch inhibitor assembly 16 of the present invention is provided for cooperation with the switch 12 to avoid such occurrence.

Referring to FIGS. 1–4, the multi-position switch 12 includes a first portion 24A of the support base 24 defining an elongated channel 48. The switch actuator 14 includes an elongated stem 50 and a transverse head 52 attached on an outer end 50A (see FIG. 11) of the stem 50. The outer end 50A of the stem 50 projects through the elongated channel 48 in a transverse relationship thereto and positions the transverse head 52 in a substantially parallel relationship to the elongated channel 48. The head 52 has a knurled outwardly-facing surface 52A which is contacted by the user's finger to move the switch actuator head 52 and stem 50 and thus the switch actuator 14 along the elongated channel 48 between the succession of multiple positions of the switch 12.

Referring to FIGS. 2–7, the switch inhibitor assembly 16 of the present invention is incorporated on the support plate 24 of the housing unit 18 adjacent to the three-position switch 12. The switch inhibitor assembly 16 is operable for inhibiting movement of the switch actuator 14 along the elongated channel 48 to a predetermined one of the multiple positions of the switch 12, preferably the right ON position, from the other of the multiple positions of the switch 12, the left OFF and middle AUTO positions. The switch inhibitor assembly 16 basically includes a second portion 24B of the support base 24 disposed adjacent to the first portion 24A thereof and defining an elongated slot 54 spaced from one end portion 48A of the elongated channel 48, and a mechanical slide actuator 56 mounted to the second portion 24B of the support base 24 for undergoing sliding movement along the elongated slot 54. The elongated slot 54 is aligned and extends in a generally transverse relationship to the elongated channel 48 at the one end portion 48A thereof and so the slide actuator 56 is movable in the transverse relationship to and toward and away from the one end portion 48A of the elongated channel 48 between unblocking and blocking positions, as shown respectively in FIGS. 8 and 11.

More particularly, the slide actuator 56 has a flat body 58, an L-shaped end portion 60 integrally attached to and extending from a lower end of the flat body 58, a snap-in bifurcated attachment lug 62 integrally attached to and projecting from a rear face 58A of the flat body 58 and rib 64 integrally attached to and projecting from a front face 58B of the flat body 58. The rib 64 permits gripping of the slide actuator 56 to move the same between the unblocking and blocking positions. The second portion 24B of the support base 24 is recessed rearwardly from a front surface 24C of the support base 24 so as to defined a cavity 66 in which the flat body 58 of the slide actuator 56 is slidably fitted and seated with the bifurcated attachment lug 62 snap-fitted through the elongated slot 54. The lug 62 has a conical-shaped head portion 62A and a longitudinal slit 62B extending from the head 62A partially through a stem portion 62C of the lug 62 which permits flexing of the stem portion 62C and inward movement of the split parts of the head portion 62A toward one another so as to allow easy installation and removal of the slide actuator 56 respectively to and from the elongated slot 54 and at the same time makes it easy to slidably move the slide actuator 56 between the unblocking and blocking positions.

Figure 3:
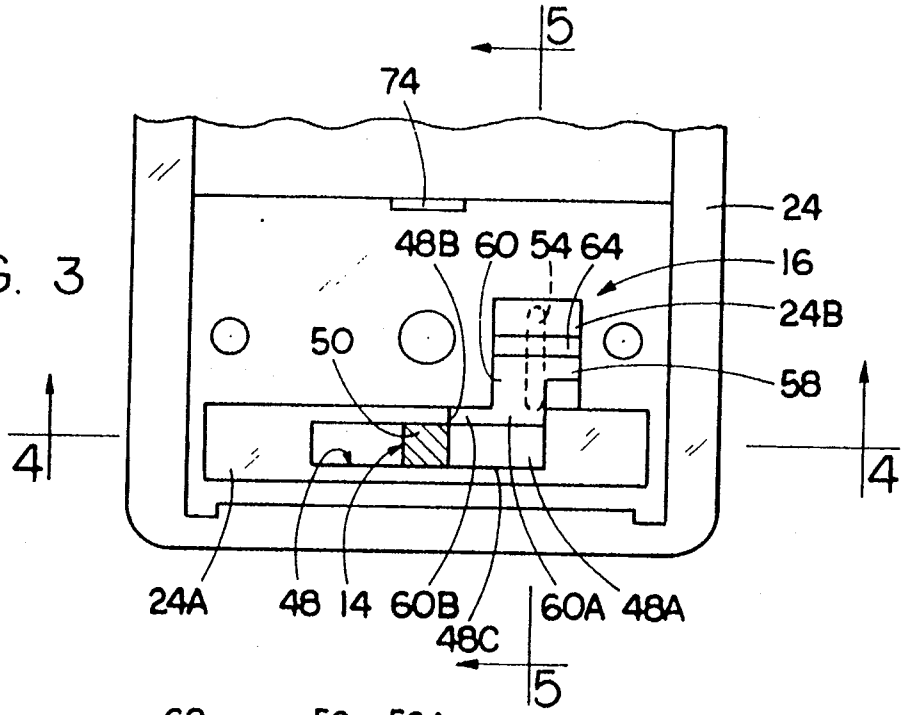
FIG. 3 is an enlarged fragmentary front elevational view of the unit showing a slide actuator of the switch inhibitor assembly at an unblocking position and showing a switch actuator of the switch at an AUTO position of the switch.
Figure 4:
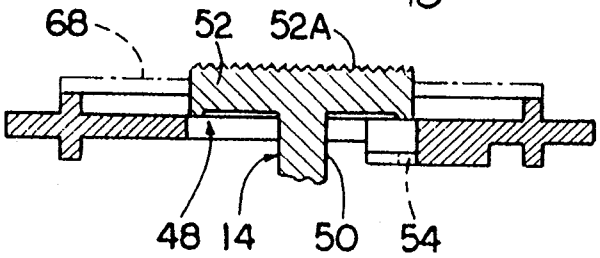
FIG. 4 is a horizontal sectional view taken along line 4—4 of FIG. 3.
Figure 10:
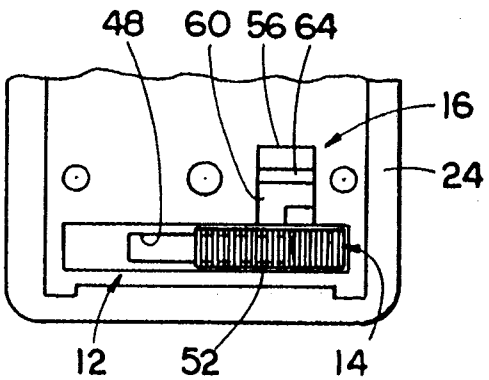
FIGS. 8, 9 and 10 are respective enlarged fragmentary front elevational views of the unit showing the switch actuator of the switch at OFF, AUTO and ON positions of the switch and showing the slide actuator of the switch inhibitor assembly at an unblocking position.
Figure 9:
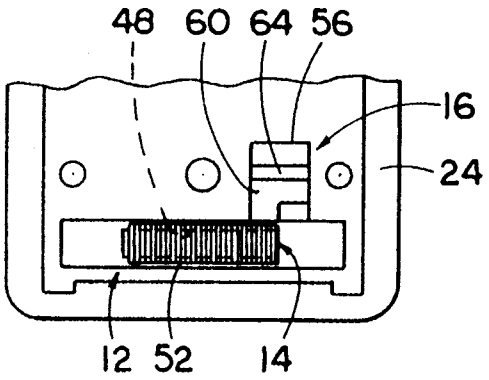
Figure 8:
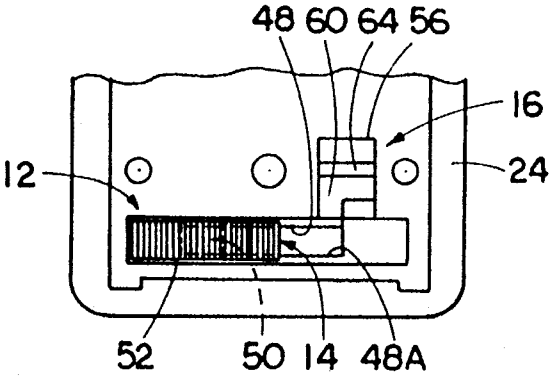

The first portion 24A of the support plate 24 defining the elongated channel 48 has an upper edge portion 48B at the one end portion 48A thereof which has been removed for receiving the lower edge 60A of the L-shaped end portion 60 of the flat body 58 when the slide actuator 56 is disposed in the unblocking position shown in FIG. 3. At the unblocking position shown in FIGS. 3 and 8–10, the L-shaped end portion 60 of the flat body 58 of the slide actuator 56 is retracted from across the right end portion 48A of the elongated channel 48 and thereby permits movement of the switch actuator 14 from the other positions along the right end portion 48A of the elongated channel 48 to the predetermined ON position of the switch 12.

Figure 13:
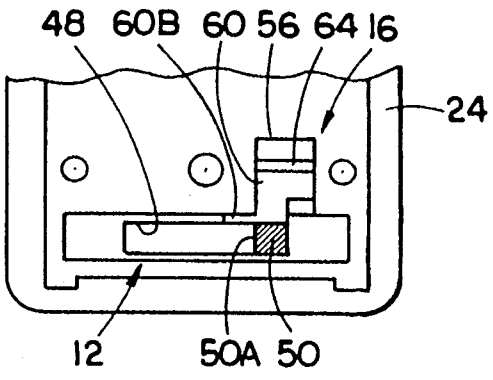
FIGS. 11, 12 and 13 are respective enlarged fragmentary front elevational views of the unit showing a head portion of the switch actuator broken away and the slide actuator of the switch inhibitor assembly at a blocking position in FIGS. 6 and 7, allowing the switch actuator to be moved only between adjacent OFF and AUTO positions, and at the unblocking position in FIG. 8, allowing the switch actuator to be moved also to the ON position.
Figure 12:
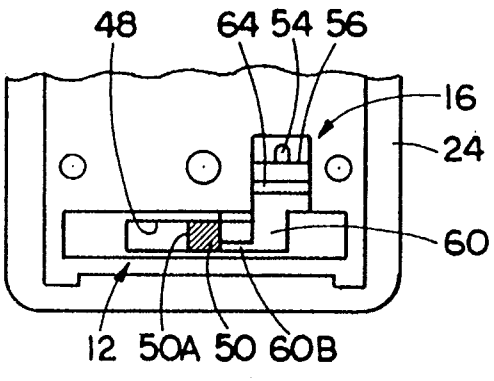
Figure 11:
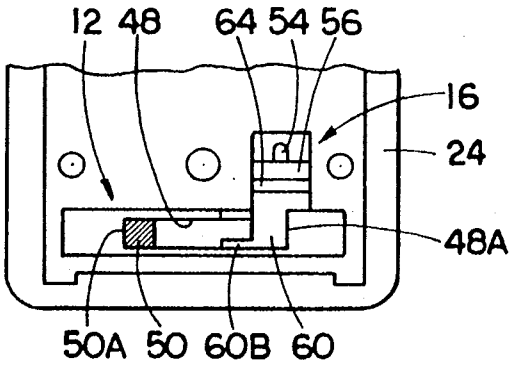

When the slide actuator 56 is moved to the blocking position shown in FIGS. 11 and 12, the L-shaped end portion 60 of the flat body 58 extends across the one end 48A of the elongated channel 48 and contacts the opposite edge portion 48C of the elongated channel 48 at the right end portion 48A thereof and a tang 60B on the L-shaped end portion 60 becomes engaged by the outer end 50A of the stem 50 of the switch actuator 14 when the latter has been moved from the left OFF position shown in FIG. 11 to the middle AUTO position shown in FIG. 12. At the blocking position, therefore, the switch actuator 14 is prevented from moving from the middle AUTO position shown in FIG. 12 along the right end portion 48A of elongated channel 48 to the right ON position shown in FIG. 13.

A removable shield plate 68 is also provided so as to prevent unauthorized access to the slide actuator 56. The shield plate 68 has a middle upper lug 70 and a pair of laterally spaced lower lugs 72. The upper lug 70 is insertable into a slot 74 in the support plate 24 while the lower lugs 72 are overlapped by a lower portion 42A of the interior edge of the front cover plate 42 defining the opening 46 therein when the front cover plate 42 is installed on the front side of the housing unit 18. Thus, the shield plate 68 is normally mounted to the support plate 24 and positioned over the slide actuator 56 so as to prevent unauthorized access to the slide actuator 56 without first removing the shield plate 68 which, in turn, requires that the front cover plate 42 be removed first.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. In combination with a multi-position switch which includes means defining an elongated channel and a switch actuator projecting into said elongated channel and being movable along said elongated channel between multiple positions of said switch, a switch inhibitor assembly for inhibiting movement of said switch actuator to a predetermined one of said multiple positions of said switch from the other of said multiple positions thereof, said switch inhibitor assembly comprising:

(a) means defining an elongated slot spaced from said elongated channel and extending in a generally transverse relationship to said elongated channel; and (b) a slide actuator mounted to said elongated slot for undergoing sliding movement therealong and toward and away from said elongated channel and between a blocking position in which a portion of said slide actuator extends across a portion of said elongated channel and thereby prevents movement of said switch actuator along said portion of said elongated channel to said predetermined one position of said switch, and an unblocking position in which said portion of said slide actuator is retracted from across said portion of said elongated channel and thereby permits movement of said switch actuator along said portion of said elongated channel to said predetermined one position of said switch;

(c) said slide actuator including a body and an attachment lug attached to and projecting from a rear face of said body and having means for snap-fitting said attachment lug through said elongated slot so as to allow easy installation and removal of said attachment lug and thereby said slide actuator respectively to and from said elongated slot.

2. The switch inhibitor assembly as recited in claim 1, wherein said snap-fitting means of said attachment lug includes a conical-shaped head portion and a stem portion with a longitudinal slit extending from said head portion partially through said stem portion to permit flexing of said stem portion and inward movement of split parts of said head portion toward one another so as to allow said easy installation and removal of said slide actuator respectively to and from said elongated slot.

3. The switch inhibitor assembly as recited in claim 1, wherein said slide actuator includes a rib attached to and projecting from a front face of said body to permit gripping of said slide actuator to move the same between said unblocking and blocking positions.

4. The switch inhibitor assembly as recited in claim 1, wherein said slide actuator includes a body and a rib attached to and projecting from a front face of said body to permit gripping of said slide actuator to move the same between said unblocking and blocking positions.

5. The switch inhibitor assembly as recited in claim 1, wherein said elongated channel has an edge at said portion thereof which is removed for receiving a lower edge of said portion of said slide actuator when said slide actuator is disposed in said unblocking position.

6. In combination with a multi-position switch which includes a support base having a first portion defining an elongated channel and a switch actuator having a portion projecting into said channel and being movable along said channel between multiple positions of said switch, a switch inhibitor assembly for inhibiting movement of said portion of said switch actuator along said elongated channel to a predetermined one of said multiple positions of said switch from the other of said multiple positions of said switch, said switch inhibitor assembly comprising:

(a) a second portion of said support base defining an elongated slot spaced from said elongated channel in said first portion of said support base and extending in a generally transverse relationship to said elongated channel; and (b) a slide actuator mounted to said second portion of said support base for undergoing sliding movement along said elongated slot and toward and away from said elongated channel and between a blocking position in which a portion of said slide actuator extends across a portion of said elongated channel and thereby prevents movement of said switch actuator along said portion of said elongated channel to said predetermined one position of said switch, and an unblocking position in which said portion of said slide actuator is retracted from across said portion of said elongated channel and thereby permits movement of said switch actuator along said portion of said elongated channel to said predetermined one position of said switch;

(c) said slide actuator including a body and an attachment lug attached to and projecting from a rear face of said body and having means for snap-fitting said attachment lug through said elongated slot so as to allow easy installation and removal of said attachment lug and thereby said slide actuator respectively to and from said elongated slot.

7. The switch inhibitor assembly as recited in claim 6, wherein said snap-fitting means of said attachment lug includes a conical-shaped head portion and a stem portion with a longitudinal slit extending from said head portion partially through said stem portion to permit flexing of said stem portion and inward movement of split parts of said head portion toward one another so as to allow said easy installation and removal of said slide actuator respectively to and from said elongated slot.

8. The switch inhibitor assembly as recited in claim 6, wherein said slide actuator includes a rib attached to and projecting from a front face of said body to permit gripping of said slide actuator to move the same between said unblocking and blocking positions.

9. The switch inhibitor assembly as recited in claim 6, wherein said slide actuator includes a body and a rib attached to and projecting from a front face of said body to permit gripping of said slide actuator to move the same between said unblocking and blocking positions.

10. The switch inhibitor assembly as recited in claim 6, wherein said elongated channel has an edge at said portion thereof which is removed for receiving a lower edge of said portion of said slide actuator when said slide actuator is disposed in said unblocking position.

11. The switch inhibitor assembly as recited in claim 6, wherein:

said second portion of said support base is recessed from a front surface of said support base so as to defined a cavity; and said slide actuator having a flat body being slidably fitted and seated within said cavity.

* * * * *